US005766073A

United States Patent [19]

O'Kelley

[11] Patent Number: 5,766,073

[45] Date of Patent: Jun. 16, 1998

[54] EXHAUST HEADER FOR BUILDING VENTILATOR FAN

[76] Inventor: Charles H. O'Kelley, Rte. 2, Box 293, Diagonal, Iowa 50845

[21] Appl. No.: 788,037

[22] Filed: Jan. 23, 1997

[51] Int. Cl.[6] ..... F24F 7/013

[52] U.S. Cl. ..... 454/354; 454/356

[58] Field of Search ..... 454/16, 32, 350, 454/351, 354, 355, 356, 368

[56] References Cited

U.S. PATENT DOCUMENTS

| | | | |
|---|---|---|---|
| 164,636 | 6/1875 | Creamer . | |
| 912,076 | 2/1909 | Cochran | 454/32 |
| 1,097,387 | 5/1914 | Breidert . | |
| 1,336,470 | 4/1920 | McDonald . | |
| 1,435,913 | 11/1922 | Breidert . | |
| 1,645,283 | 10/1927 | Hansen . | |
| 2,332,552 | 10/1943 | Belanger | 454/356 X |
| 2,813,473 | 11/1957 | Schepens . | |
| 2,868,105 | 1/1959 | Knutson et al. | 454/355 |
| 4,768,424 | 9/1988 | Frenkler et al. | 454/355 |
| 4,850,267 | 7/1989 | Peterson | 454/354 X |
| 5,080,005 | 1/1992 | Kolt . | |
| 5,167,578 | 12/1992 | Legault | 454/354 X |
| 5,421,776 | 6/1995 | Sakamoto et al. . | |

*Primary Examiner*—Harold Joyce

*Attorney, Agent, or Firm*—Zarley, McKee, Thomte, Voorhees, & Sease

[57] ABSTRACT

An apparatus and method for handling and controlling exhaust from a ventilation fan. A header is placed over the exterior end of the exhaust air conduit used to exhaust air by the ventilation fan. The header provides upper and lower air paths for the exhaust, but blocks direct wind from entering the air conduit. The upper and lower air paths terminate in exhaust openings. The exhaust openings are similar is size to one another and are similar in cross-sectional area to the air paths through the header.

19 Claims, 3 Drawing Sheets

EXHAUST HEADER FOR BUILDING VENTILATOR FAN

BACKGROUND OF THE INVENTION

A. Field Of The Invention

The present invention relates to exhaust fans, and in particular, to exhaust conduits, hoods or wind diverters for exhaust fans used, for example, to ventilate buildings.

B. Problems In The Art

Confinement buildings for livestock such as hogs require that air be ventilated from the building. Not only is cooling of the interior of the building a concern, when cooling is needed it is usually important to exhaust the existing air to get rid of moisture and smell, and to replace it with fresh air with additional oxygen.

The traditional way of ventilating such buildings is to utilize what will be called fan assemblies which include a fan or fan blade which is usually driven by an electric motor. They can have a tubular cowl, housing or frame around the fan which forms an air conduit or pathway between the area to be ventilated, usually the interior of the building, and an exhaust area, usually the exterior of the building. These fan assemblies are configured to essentially suck air out of the building and exhaust it to the exterior. As is well known, this is attempted to be accomplished by creating lower pressure on the exterior side of the fan, so that air at higher pressure on the interior side of the fan seeks to move to the lower pressure area. These fan assemblies can not only be placed through building walls, but could also be placed on building roofs or in other locations.

It is to be understood that sometimes the fans need to run at maximum capacity (for example in summertime) to attempt to move air as fast as possible to assist in cooling of the building interior. Other times they do not need to run at maximum capacity, for example in the wintertime when heat retention inside the building is needed. The fans still need to keep replacing the air, but many times this can be adequately accomplished with only intermittent operation of the fans and/or operation at less than full capacity.

The size and capacity of fans used for these ventilation purposes can vary widely. As is well known by those skilled in the art, the size of the fan blades, the type of blades, the revolutions per minute (RPM), and the motor type and size, all can affect the movement of air. One measure of this relates to the amount of cubic-feet per minute (CFM) of air which the fan assembly can move.

There are certain problems or concerns that exist with conventional ventilation fan assemblies that simply have a tubular conduit through the building boundary, with a fan in the conduit.

First of all, winds directly into the exterior end of the conduit can greatly reduce the efficiency of the ventilation because they would directly counteract the efforts of the fan assembly to move air outwardly. If the wind is strong enough, relative to the capacity of the motor and fan blade, it can actually overcome the fan assembly and block ventilation, or even cause air to flow into the building. Air packing can be produced. As it implies, air packing works against ventilation. Wind or pressures outside move air inwardly through the fan assembly, while the fan assembly tries to push air outwardly. The competing air streams essentially pack into the air conduit, causing a stalemate as far as air flow in either direction.

If a fan is running at 100% of capacity, it usually does not let air into fan. But when slowed down, then air may come in, caused for example by wind or barometric pressures, and "pack" the fan. It may be substantial enough to essentially overcome the fan. Ventilation would stop. A proper exhaust rate would be lost, moisture may build up, odors would accumulate, respiratory diseases are more likely to arise, and temperature maintenance could be lost. It can also create problems with the functioning of the fan.

Second, environmental conditions such as rain, snow, or sleet, under the right conditions, can enter the conventional fan assemblies or even the building. This is likewise true of air-borne particles, such as dust, dirt, and even small debris.

Third, exterior atmospheric conditions, such as humidity, barometric pressure, updrafts and down drafts, can create pressures which must be overcome by the fan assembly to maintain ventilation. The existence of these types of conditions can, at a minimum, cause the motor driving the fan blade to have to work harder, which can reduce motor life and increase energy costs.

Fourth, in most situations, it is advantageous or even critical, that the exhaust capacity be variably controllable. As discussed above, in areas where the seasons bring significant temperature changes, summertime CFM needs may be very different than in wintertime. Even the differences between daytime and nighttime needs can be dramatic.

The operator of the building can use ventilation to assist in temperature maintenance, comfort maintenance, odor reduction, and other characteristics. The ability to manipulate ventilation through varying the speed (RPM) of the motor can help control the matters set forth above, as well as dramatically cut unnecessary energy costs.

Fifth, the structure of ventilation systems can not be overly complex. Generally, a number of fan assemblies are used per building. Complex structures would require more maintenance and be more suspect to break down because of the direct exposure to outside environmental conditions. Complexity also generally means more cost.

There have been attempts to address the problems set forth above. One example is known as the "hub cap" exhaust cover. It is basically a round plate held across, but spaced from, the outer end of the air conduit of the exhaust fan assembly. These types of devices help block direct head winds, but do not address side winds or drafts. If placed close to the end of the conduit, they may unduly block the exhaust. Also, it would not necessarily block precipitation from entering between the cover and the exhaust conduit.

Another commonly used device is sometimes called an "exhaust hood", and basically comprises a tubular member that fits on the end of the exhaust conduit. The tubular member extends outwardly a distance and then turns downwardly so that its only opening faces the ground. This arrangement blocks both head winds and precipitation from above or the sides. However, it can receive wind coming from beneath (such as an updraft). It also presents only one outlet for the exhaust. Therefore, if there is an updraft or relatively high pressure at the outlet, it may cause air packing, or at least, strain the motor.

A need has been identified in the art for an improved apparatus and method of blocking wind and precipitation but not unduly restricting exhaust flow. The existing devices and methods do not adequately address those needs. As set forth above, the competing needs of the exhaust fan are, first, the ability to pump air out of the building without too much restriction. This generally leads to having as unrestricted an exit air pathway as possible. Secondly, there is a need to protect the exhaust fan from head winds, precipitation, and other environmental matters. This generally leads to restricting the openness of the exit pathway, or at least creating some sort of shield from wind and precipitation, which ordinarily will partially block a direct exhaust pathway. Therefore, it has been recognized that the goal for these devices must be a balance between not having too much blockage of the exhaust pathway(s) but having enough to deal effectively with the problems discussed above such as wind, air pressure, precipitation, etc.

Other devices have been discovered which purport to address exhaust outlet problems. For example, U.S. Pat. No. 5,421,776 to Sakamoto, entitled "Exhaust Air Hood", discloses a hollow plate member at the end of a hollow tubular body that is attached to the outer end of an exhaust fan assembly. There are opposite openings in the plate member, comprising the only outlets for the exhaust. The hollow plate member is intentionally narrowed towards both ends, so that the openings are smaller than the cross-sectional area at the middle of the plate member. This structure is purported to reduce back flows through exhaust air ports caused by wind pressure, thus enabling a proper ventilation system to be achieved. The patent discloses that the narrowed ends cause a rotational vortex to be set up in the hollow plate, which facilitates proper ventilation.

U.S. Pat. 4,850,267 to Peterson, entitled "Wind Diverter for Ventilator Fans", discloses an exhaust conduit with its end cut at an angle and a cone-shaped member held in an extended position in front of the angled end. Head winds are blocked, but similar to the "hub cap" type devices discussed above, wind or the elements can enter around the sides of the cone.

A number of ventilator covers used for residential or office buildings are known in the art. Many of them are passive, in the sense that there is no powered fan driving the air through the ventilator cover. Many of these types of devices are complex in structure, expensive to manufacture, and difficult to maintain because of the complex structure. Such structure is sometimes required to keep pests or animals out. Examples are:

U. S. Pat. 164,63 TO CREAMER

U. S. Pat. 1,097,38 TO BREIDERT

U. S. Pat. 1,336,47 TO MCDONALD

U. S. Pat. 1,435,91 TO BREIDERT

U. S. Pat. 1,645,28 TO HANSEN

U. S. Pat. 2,813,47 TO SCHEPENS

U. S. Pat. 5,080,00 TO KOLT

It is also to be understood that one way to address at least many of the problems set forth above would be to increase the CFM rate by, for example, using larger fans and/or fan motors. However, this adds greatly to cost, not only of the equipment and parts, but the energy requirements.

The inventor has found that the above types of solutions are not satisfactory. Wind can still affect many of the prior art structures and, according to his experience, one can end up with "air packing"—the wind or barometric pressure can basically work against the exhaust and pack air in a manner that could alter the exhaust function.

This is particularly true if the fans are not required to run at full capacity, for example, in winter when you do not want too much ventilation because you do not want the building to be cooled to an inappropriate level. Wind, barometric pressure, and other environmental conditions can cause the fan to work inefficiently or ineffectively.

As discussed previously, if there is not effective ventilation, moisture could build up in the building, lack of oxygen can be created, smell can be increased to an unacceptable level, respiratory problems can occur, and cold can actually infiltrate back into the building.

It is therefore a principal object of the present invention to provide an apparatus and method for an exhaust header for ventilation fan assemblies that solves the problems or overcomes the deficiencies of the prior art.

Further objects, features, and advantages of the present invention are to provide an exhaust header and method of controlling exhaust which:

a. Divert head and side winds.
b. Handle exterior air conditions.
c. Handle precipitation/weather/environmental conditions.
d. Facilitate variable control of air flow.
e. Maintain temperature.
f. Maintain comfort.
g. Reduce energy costs and deter unnecessary energy costs.
h. Eliminate complexity in structure and operation.
i. Provide economy, durability, and flexibility.

These and other objects, features, and advantages of the invention will become more apparent with reference to the specification and claims as follows.

SUMMARY OF THE INVENTION

The present invention is an apparatus and method for an exhaust header for a ventilation fan assembly. The invention allows control of a very large percentage of exterior air resistance against full run and variable speed exhaust fans.

The apparatus according to the invention includes a tubular header member having openings in opposite ends. The tubular header member is attachable directly to an exhaust conduit of a ventilation fan assembly, or utilizes a tubular connection member connected at one open end to the tubular header member at a point between its open ends, and at its other open end to the exhaust conduit of the ventilation fan assembly. The tubular header member is configured so that each opening in opposite ends has an area that is substantially similar to the cross sectional area of the tubular member at its other locations along its length.

The method according to the present invention includes dividing exhaust from a ventilation fan assembly so that a portion can go upwardly and a portion can go downwardly, if needed. Precipitation, head winds and air pressure are not allowed directly into the fan conduit, but if one of the openings is blocked or at a pressure that does not allow easy exhaust from the fan, the other opening is available.

Other features and options of the invention are set forth in other parts of this specification.

DETAILED DESCRIPTION OF THE INVENTION

A. Overview

Figure 1:
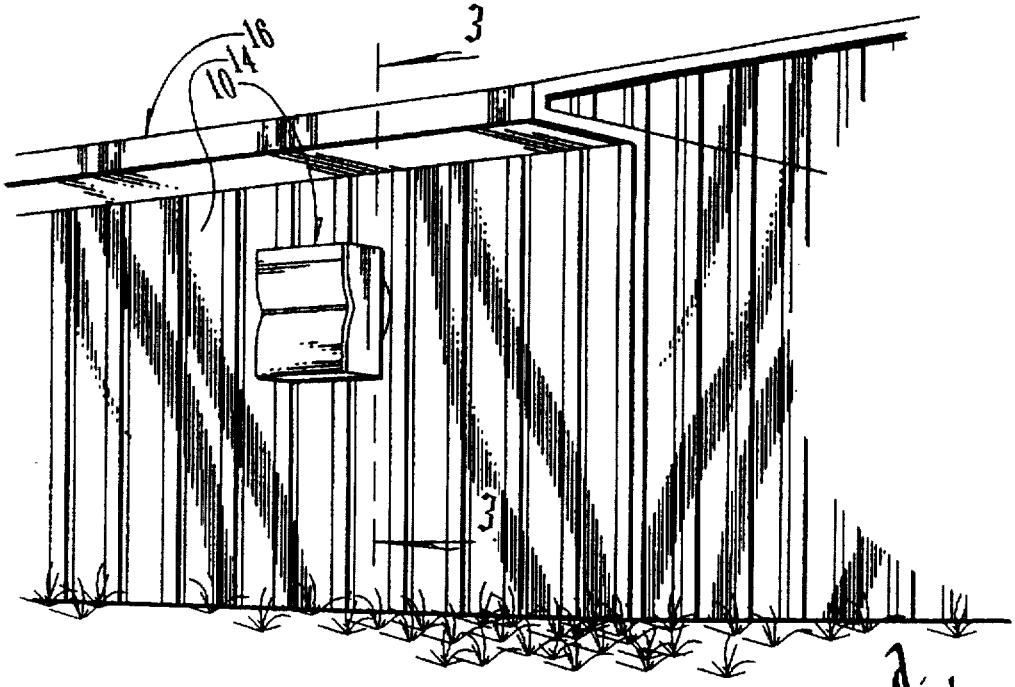
FIG. 1 is a perspective view of an outer wall of a building with a ventilation fan assembly installed in the wall and a preferred embodiment of an apparatus according to the present invention installed with respect to the ventilation fan.

To provide a better understanding of the invention, one specific embodiment will now be described in detail. The description will refer frequently to the accompanying drawings. Reference numerals will be used to indicate certain parts and locations in the drawings. The same reference numerals will be used to indicate the same parts and locations throughout the drawings, unless otherwise indicated.

The general structure of an apparatus according to the preferred embodiment will be first set forth, followed by a description of the use and operation of the apparatus. Options, features, and alternatives will complete this description.

B. The Apparatus Generally

FIG. 1 depicts an apparatus (herein described as device 10), according to a preferred embodiment of the invention. Device 10 is mounted to the outer end of a ventilation fan assembly air conduit 12 (see FIG. 3) which in turn is mounted in wall 14 of building 16. Here building 16 is a corrugated metal hog confinement building, but it is to be understood that building 16 can be many different types of structures.

Figure 2:
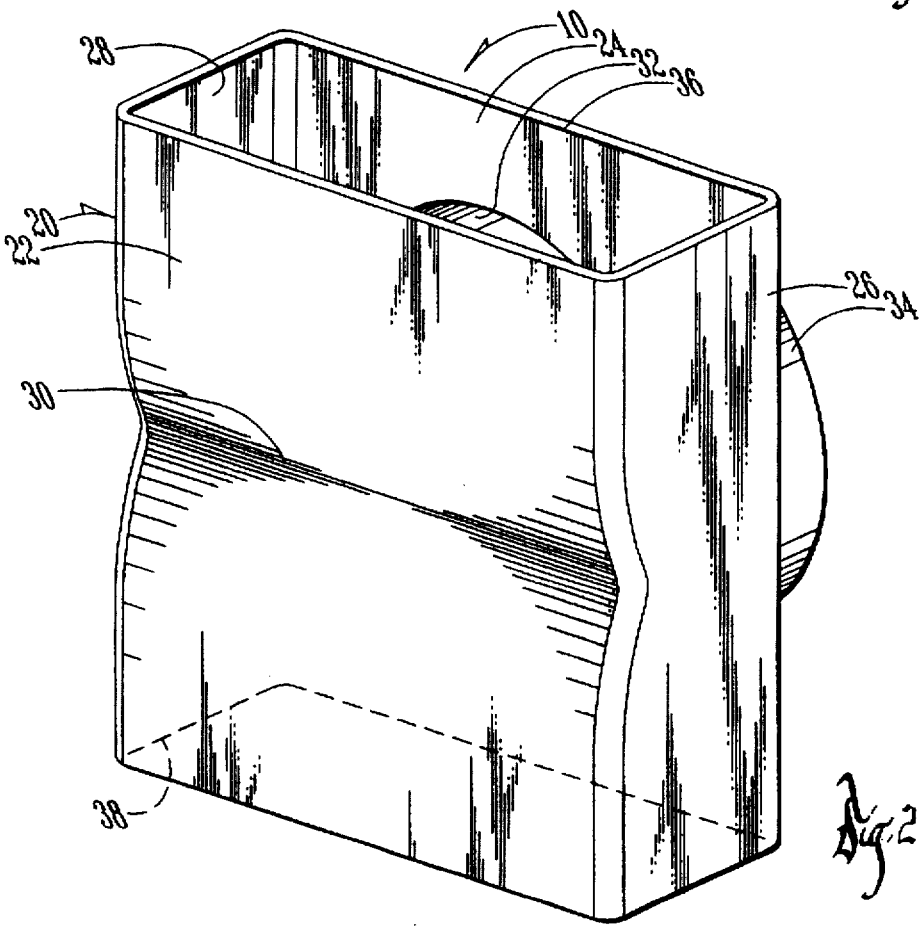
FIG. 2 is an enlarged perspective view of the preferred embodiment of the present invention shown in FIG. 1.

FIG. 2 shows device 10 enlarged and isolated. In this embodiment a generally rectangular header or tubular member 20, has front, back, right and left walls 22, 24, 26, and 28. Front and back walls 22 and 24 are basically parallel and of the same dimensions, except that front wall 22 includes a horizontal indentation 30, whose function will be described later, and back wall 24 includes an opening 32 around which is attached connection tube 34. Right and left side walls 26 and 28 are basically parallel and of the same dimensions. Member 20 therefore is substantially a rectangular-in-cross-section tube. The top and bottom openings 36 and 38 of member 20 are therefore generally of the same or similar area as the cross-sectional area taken at most places along member 20.

Figure 3:
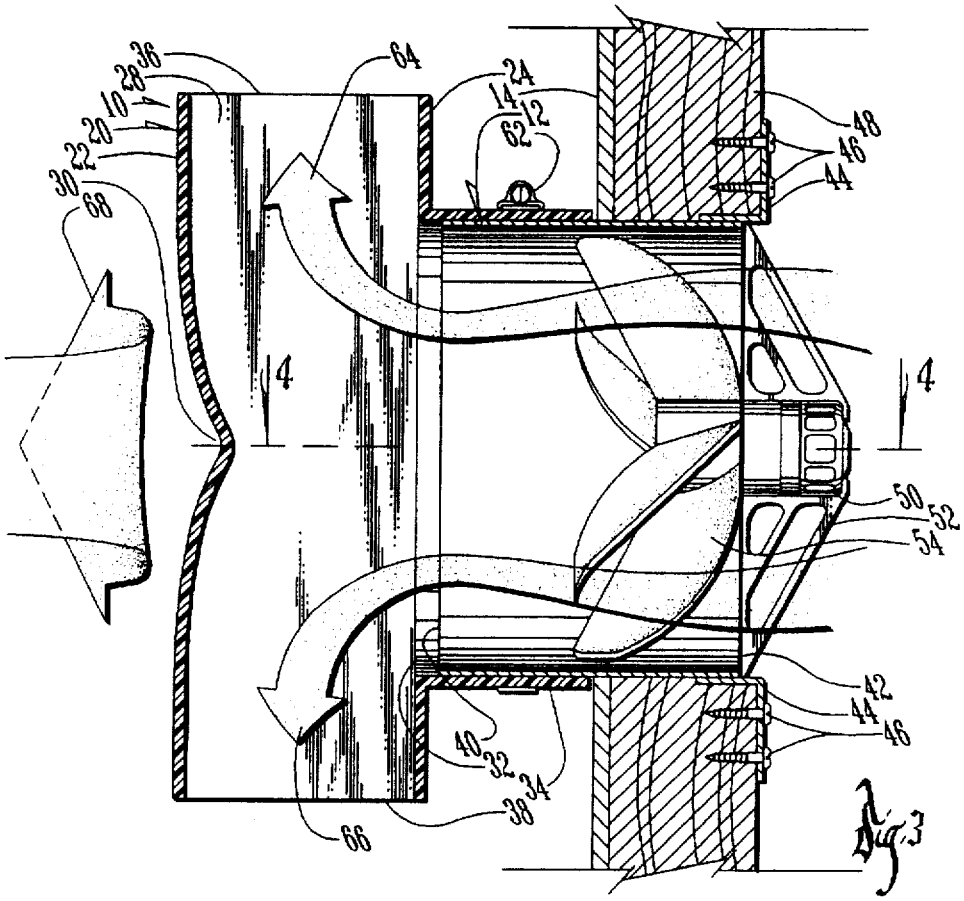
FIG. 3 is an enlarged side elevation, sectional view taken along line 3—3 of FIG. 1 and showing in detail the ventilation fan assembly, comprising a fan blade, a fan motor, and a cowling or air conduit around both, and further showing how the apparatus of the preferred embodiment blocks wind from entering the fan assembly, but allows exhaust from the building.
Figure 4:
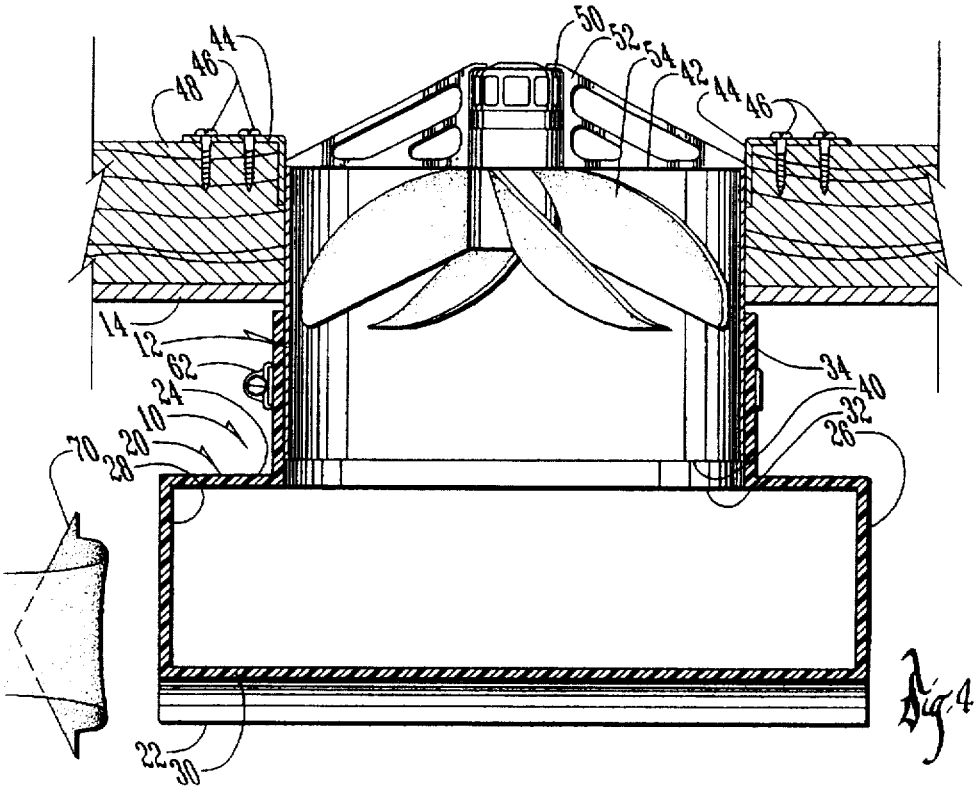
FIG. 4 is a top plan sectional view taken along line 4—4 of FIG. 3.
Figure 5:
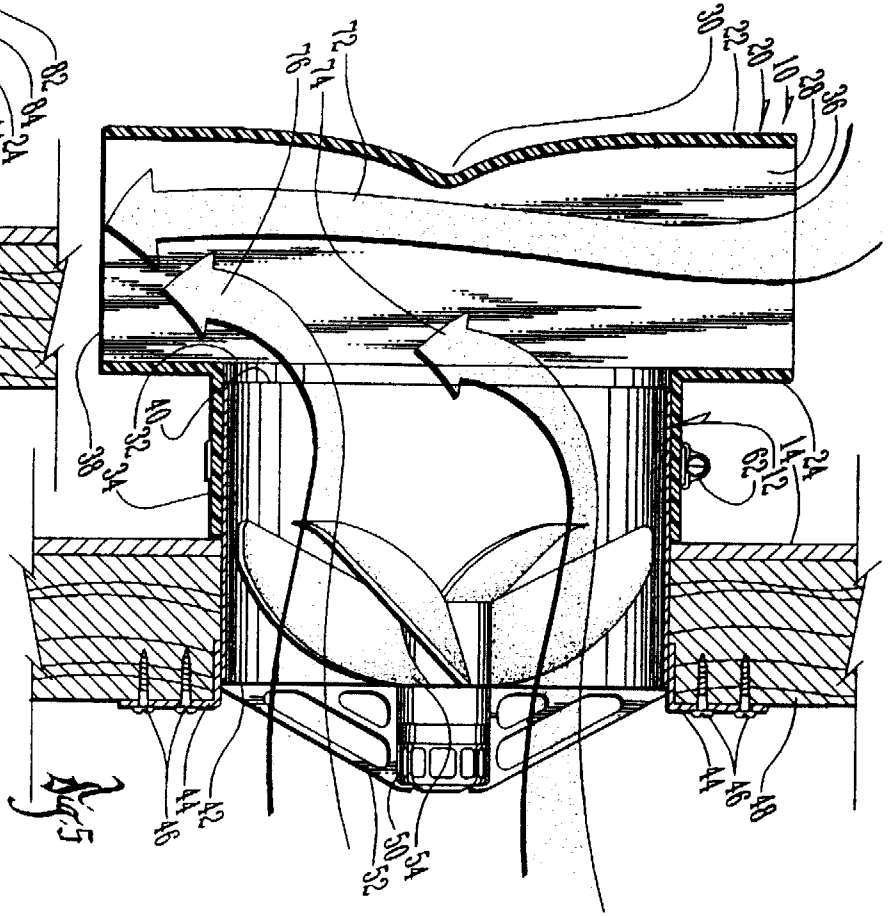
FIG. 5 is similar to FIG. 3 but illustrates that if wind or barometric pressure, for example, deter exhaust from traveling out the top of the preferred embodiment, the preferred embodiment allows the exhaust to travel out its bottom portion.
Figure 6:
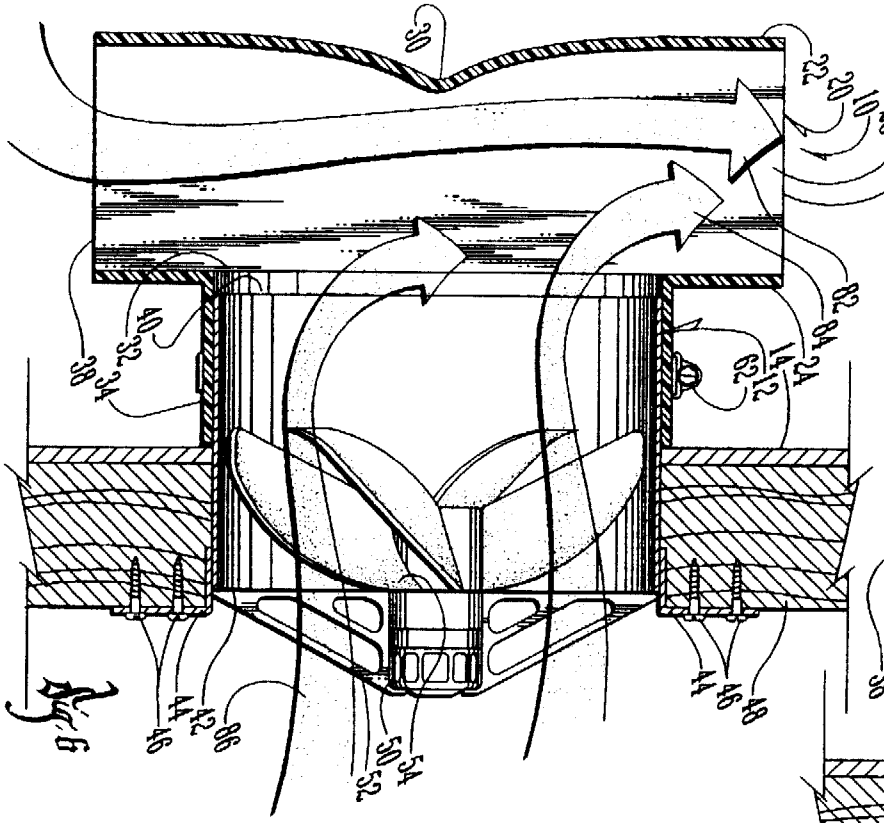
FIG. 6 is similar to FIG. 5 but shows that exhaust can exit the top if wind, barometric pressure, or other conditions deter it from exiting the bottom.

FIGS. 3 and 4 illustrate the structure of device 10 in more detail, as well as its connection to a ventilation fan assembly. The ventilation fan assembly, as that term is used herein, includes a air conduit 12, which here is a round tube extending through building wall 14 and having opposite open ends 40 and 42. In the preferred embodiment, conduit 12 is approximately 8.75" in diameter. Open end 42 is in communication with the interior of building 16. Open end 40 is in communication with the exterior of building 16. Conduit 12 can be secured to building 16 by brackets 44 (welded or otherwise secured to conduit 12) which are in turn securable to building 16, such as by screws 46 into building studs 48. Other methods of attachment are possible, such as are known in the art or well within the skill of those skilled in the art.

The ventilation fan assembly also includes a fan motor 50 mounted to or in conduit 12 by bracket 52. Other mounting methods or structures are possible. A fan blade 54 is mounted on the output shaft (not shown) of motor 50 and rotates in the direction of rotation of such output shaft when motor 50 is operated. Motor 50 can be of a variety of sizes or brands. For example it can be an electrically powered motor (for example, between 1/25 and 1/2 HP) available from a variety of manufacturers. Fan blade 54 can be an 8" diameter fiberglass blade exhaust fan available from a number of different manufacturers. Other types and sizes are, of course, possible depending on needs and circumstances.

Thus, the ventilation fan assembly of conduit 12, motor 50 and blade 54 can be operated to move air from inside building 16 to outside building 16. Used alone, the fan assembly would be susceptible to direct head winds or barometric air packing, and other problems discussed previously.

Device 10 is configured so that connection tube 34 has an inside diameter that fits over the outside diameter of conduit 12. It is preferred that the fit be fairly close so that tube 34 of device 10 mates relatively closely over the exterior end of conduit 12. As shown in FIGS. 3 and 4, a hose clamp 62, of standard configuration, can be used to hold device 10 to conduit 12. Hose clamp 62 can be tightened down upon the exterior of connection tube 34 to cinch it against the exterior of conduit 12.

Open ends 36 and 38 of member 20 of device 10 are normally positioned along a vertical axis. Connection tube 34 is inserted so that a substantial part of its length (for example, 3" to 5") is over the exterior end of conduit 12 (which can typically extend 8" to 12" out from the building wall 14). The exterior opening 40 of conduit 12 and the opening 32 at the junction of connection tube 34 and tubular member 20 are substantially the same diameter.

Indentation 30 is basically centered horizontally relative to conduit 12. As shown by arrows 64 and 66 in FIG. 3, exhaust air from the ventilation fan assembly would therefore exit conduit 12 and divide between top opening 36 and bottom opening 38. Indentation 30 will assist in dividing the exhaust air in this manner. Note also that head wind (see arrow 68) would be absolutely blocked by front wall 22 of device 10.

FIG. 4 shows the structure of FIG. 3 from a top plan view but along sectional line 4—4 of FIG. 3. Note how indentation 30 extends a distance into the interior of tubular member 20 along a horizontal line to assist in dividing the exhaust between upper and lower openings 36 and 38. Note too that any side winds (see arrow 70) from either side will be absolutely blocked by side walls 26 and 28.

The configuration of the apparatus 10 therefore allows blockage of head and side winds, facilitation of exhaust in either an upward or downward direction, or both, and passage of rain, sleet, snow directly through the top opening 36 and out the bottom opening 38, all without unduly restricting the flow of exhaust air, and it is believed, enhancing the flow of exhaust air.

It is to be understood that device 10 can be made of a variety of different constructions and materials. Its dimensions can vary from application to application. In the preferred embodiment, some salient specifications for device 10 are set forth below:

1/16th HP electric fan.

Connection tube 34—8.75" in diameter; 1/16" wall thickness; length 3.25".

Tubular member 20—4.75" deep; 11 5/8" wide; 13.75" tall; 1/8 wall thickness; indentation 30 is 1" to maximum depth.

Material—Low density polyethylene molded plastic.

C. Operation

The operation of device 10 can be best illustrated by reference to FIGS. 3–6. As previously discussed, direct winds are blocked from entry into conduit 12 by front wall 22, and side walls 26 and 28 (see arrows 68 and 70 of FIGS. 3 and 4). Exhaust air is gently divided by indentation 30 and has the choices of top opening 36 or bottom opening 38 (see arrows 64 and 66 of FIG. 3). Device 10 therefore meets and expels head-on winds with its closed front and stops direct side winds with its closed sides.

There have been found to be situations, however, when directly blocking head winds is not sufficient to deter air packing. For example, if a down draft exists (see arrow 72 of FIG. 5) and is such a magnitude that it overcomes exhaust which otherwise would leave the top of device 10, the availability of the bottom opening 38 allows all exhaust air from fan 50 (see arrows 74 and 76) to easily exit bottom opening 38. Similarly, if an updraft (see arrow 82 of FIG. 6) exists, all exhaust air (see arrows 84 and 86) can exit through top opening 36.

Similar abilities exist if barometric pressures or other conditions set up higher pressure at either the top or bottom openings 36 or 38 in device 10. The exhaust can simply move out the opposite opening.

The above examples are easier to comprehend because they are based on the assumption of "all or nothing"; that all the exhaust can simply go out one opening if the other is effectively blocked by drafts or pressure. However, it is not usually the case that an all or nothing situation exists. For example, variable temperatures (−20 to 105 degrees F.), create different demands of air volume to be exhausted for ventilation systems. High quality air systems should have fans which control volume from 100% of the fan capability, and in many cases use a variable rate to control the fan down to 10% of its volume. The variable control allows maintenance of temperature and comfort in the building without the high cost of unnecessary energy by running the fans at maximum capacity Therefore, device 10 even assists in providing for efficiency and economy when slight resistance is presented to the exhaust air at either the top or bottom opening 36 or 38. If such resistance exists, the exhaust air can simply find the path of least resistance out of device 10. It may be that this results, for purposes of discussion only, in 80% of the exhaust exiting one of the openings and 20% the other. The dual openings are useful in promoting the least resistance to exhaust flow to enhance the efficiency and thus the economy of the fans.

Device 10 blocks direct wind and precipitation, and lets vertical precipitation pass through. It actually engages up drafts and down drafts and barometric movement, with its open top and bottom, and allows them to occur. The opening opposite their natural direction allows the exhaust and the up or down drafts to move in such a natural direction.

As discussed previously, the resistance of these movements can be overcome by higher CFM or RPM. However, this adds to cost. With device 10, if slower fan rates are used, the full openings in the top and bottom allow the up or down movement of pressure air to be incorporated with the fan's inherent capacity. Exhaust is intentionally allowed to move through the device in a natural direction.

Thus device 10 accomplishes division and discharge of head winds. Its interior allows division and discharge of moving air exhaust out top and bottom. Its full top and bottom and generally straight sides promote smooth out flow of exhaust. With the wide range of exhausted air, resistance to the fan and fan motor become very important when producing correct CFM.

Reduction of opening size, like the Sakamoto patent discussed previously, causes negative pressure and puts resistance on both fan, and fan motor. Straight sides with openings allow the air to be dumped or discharged with less resistance. Therefore, device 10 develops little air pack inside the unit, exhausting at freer rates.

While lower CFM rates move through naturally, higher CFM have the capacity to be exhausted with less resistance, increasing capacity of each fan.

Size of fan and unit motor must be correlative to develop CFM capacity of the unit. These units will vary in strength and ability to product and overcome static and negative pressure.

D. Options, Alternatives, Features, and Advantages

The included preferred embodiment is given by way of example only and not by way of limitation to the invention which is solely described by the claims herein. Variations obvious to one skilled in the art will be included within the invention defined by the claims.

For example, the invention can be built in a variety of sizes to adapt to multiple fan sizes. Materials can vary, as well as manner of attachment to the fan assembly. For example, tubular connection piece 34 may not be needed in certain situations.

Moreover, different sizes for the cross sectional area of header 20 can be used. Calculation of top and bottom opening can vary in size, due to motor and resistance capabilities. It has been found, however, that certain general relationships between the size of the fan and the size of the top and bottom openings of the header 20 are workable, at least for use with hog confinement buildings.

For fans with relatively low CFM or low resistance due to low horsepower, the following equation has been used to calculate the size of the header openings: Fan diameter times pi times ¼ of fan diameter equals area of top or bottom opening 36 or 38 of header 20. Therefore, if an 8" diameter fan were used, for example, the area of either opening 36 or 38 would be $(8")*(\pi)*(8")*(1/4)$= approx. 50 sq. in. Thus the area of each opening 36 and 38 would be approximately 50 sq. in.

For fans with larger horsepower, the following equation has been used: Fan diameter times pi times ⅕ of fan diameter equals area of top or bottom opening 36 or 38 of header 20. Therefore, if an 8" diameter fan were used, for example, the area of either opening 36 or 38 would be $(8")*(\pi)*(8")*(1/5)$ =approx. 40 sq. in. Thus the area of each opening 36 or 38 would be approximately 40 sq. in. Note that for larger fans, the area of the openings in the header 20 actually can decrease and work satisfactorily.

Another general rule that has been used is that the area of the fan should approximately equal the combined area of the top or bottom opening. It is possible to get by with openings of less area however.

I claim:

1. An exhaust header for use with building ventilation fans positioned in an exhaust conduit comprising:

a first tubular section having a body with a proximal open end for mating connection to an exhaust conduit of a ventilation fan and having an open distal end;

a second tubular section having a body positioned along a longitudinal axis, the body having first and second opposite open ends along the longitudinal axis and having a generally similar cross-sectional area along its length, the interior of the body being free from any structures or devices that substantially can impair air flow therethrough;

the open distal end of the first tubular section being connected in fluid communication with the second tubular section at an opening along the body of the second tubular section.

2. The apparatus of claim 1 wherein the first tubular section is smaller in cross sectional diameter than the portion of the second tubular section to which it is attached.

3. The apparatus of claim 1 wherein the first tubular section is joined to the second tubular section generally midway along the second tubular section, and the open distal end of the first tubular section is aligned with generally the middle of the opposite interior side of the second tubular member.

4. The apparatus of claim 3 further comprising the opposite interior side of the second tubular member includes a portion that urges the division of air flow from the first tubular section between the first and second opposite open ends of the second tubular section.

5. The apparatus of claim 4 wherein the portion that urges the division of air flow comprises a built-up section along an interior wall.

6. The apparatus of claim 1 wherein the first tubular section is circular in cross-section.

7. The apparatus of claim 1 wherein the second tubular section is generally rectangular in cross-section.

8. The apparatus of claim 1 wherein each of the first and second opposite open ends of the second tubular section are generally equal in area to the cross-sectional area of any part of the second tubular section.

9. An apparatus for attachment to a ventilation fan assembly which includes a powered fan blade surrounded by and mounted in a housing, the apparatus comprising:

a tubular, T-shaped member having first, second, and third hollow legs, the interior of the legs being free from any structures or devices that substantially can impair air flow therethrough;

the first and second legs generally aligned along an axis and terminating in open ends positioned along the axis;

the third leg being generally perpendicular to the first and second legs and terminating in an open end;

the cross-sectional area of each open end of the first and second legs being substantially similar as the cross-sectional area of the open end of the third leg.

10. The apparatus of claim 9 wherein first and second legs combine to form a hollow, rectangular-in-cross-section header.

11. An improved ventilation or exhaust fan assembly comprising:

a tubular fan housing including a first end having an opening positionable in a space to be ventilated, and a second end having an opening positionable outside the space to be ventilated;

a fan blade positioned inside the fan housing;

a motor connected to the fan blade;

a control circuit operatively connected to the fan motor;

an exhaust hood connected to the second end of the fan housing, the exhaust hood comprising a tubular header member mounted transversely across and in fluid communication with the second end of the fan housing, the tubular header member having first and second opposite open ends positioned along a longitudinal axis, and a substantially similar cross-sectional diameter between said first and second opposite open ends;

so that a T-shaped exhaust path for ventilated air is formed by the fan housing and the header member, to block wind from directly entering the fan housing and to provide plural exhaust outlets for ventilated air, the interior of the exhaust path being free from any structures or devices that impair air flow therethrough.

12. The apparatus of claim 11 wherein the fan size is related to the area of either the first or second opposite open ends by the following equation:

fan diameter times pi times fan diameter divided by a number between 3 and 8 equals area of open end.

13. The apparatus of claim 12 wherein the number between 3 and 8 is 4 for relatively low horsepower motors associated with said fan.

14. The apparatus of claim 12 wherein the number between 3 and 8 is 5 for relatively larger horsepower motors associated with said fan.

15. The apparatus of claim 11 wherein the cross sectional area of the tubular header is relatively similar along its length.

16. The apparatus of claim 11 wherein the perimeter dimensions of the exhaust hood exceed the perimeter dimensions of the tubular fan housing.

17. An exhaust hood comprising:

a generally rectangular in cross-section member having a generally straight longitudinal axis, a top, bottom, front, back, left side and right side defining an interior void in the member, the interior void of the body being free from any structures or devices that impair air flow therethrough and being generally of consistent cross-sectional area;

openings in the top and bottom of the member positioned along the longitudinal axis in fluid communication with the interior void;

a connection opening in the back of the member and in fluid communication with the void.

18. A method of controlling exhaust from a ventilation fan assembly including a tubular air conduit in which is positioned an exhaust fan, comprising:

blocking wind from directly entering the air conduit;

providing two exhaust pathways for exhaust air traveling through the air conduit, each exhaust pathway having a cross-sectional area that is relatively consistent along its length wherein the two exhaust pathways are generally opposite, in fluid communication, and along a generally vertical axis.

19. The method of claim 18 wherein the two exhaust pathways are substantially enclosed.

* * * * *